US009280115B2

(12) United States Patent
Nagai

(10) Patent No.: US 9,280,115 B2
(45) Date of Patent: Mar. 8, 2016

(54) IMAGE FORMING APPARATUS WITH CONSUMPTION PREDICTION, METHOD OF CONTROLLING THE SAME, AND NON-TRANSITORY COMPUTER-READABLE MEDIUM

(71) Applicant: CANON KABUSHIKI KAISHA, Tokyo (JP)

(72) Inventor: Jun Nagai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/171,998

(22) Filed: Feb. 4, 2014

(65) Prior Publication Data

US 2014/0233969 A1 Aug. 21, 2014

(30) Foreign Application Priority Data

Feb. 20, 2013 (JP) ..... 2013-031425

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
CPC ..... G03G 15/556; G03G 15/5041; G03G 15/5058; G03G 2215/00029
USPC ..... 399/27, 49, 58; 358/1.9, 3.06
See application file for complete search history.

(56) References Cited

U.S. PATENT DOCUMENTS

| | | | | |
|---|---|---|---|---|
| 5,349,377 | A * | 9/1994 | Gilliland et al. | 347/131 |
| 5,724,627 | A * | 3/1998 | Okuno et al. | 399/27 |
| 5,867,198 | A * | 2/1999 | Gwaltney et al. | 347/131 |
| 6,810,218 | B1 * | 10/2004 | Wong et al. | 399/27 |
| 7,054,014 | B2 * | 5/2006 | Foster et al. | 358/1.1 |
| 7,302,198 | B2 * | 11/2007 | Ahn | 399/27 |
| 7,804,629 | B2 * | 9/2010 | Jacobs et al. | 358/504 |
| 2006/0127108 | A1 * | 6/2006 | Okuyama et al. | 399/27 |
| 2006/0140650 | A1 * | 6/2006 | Yokote | 399/27 |
| 2010/0098443 | A1 * | 4/2010 | Oka | 399/39 |

FOREIGN PATENT DOCUMENTS

| | | | |
|---|---|---|---|
| JP | 09-022226 | A | 1/1997 |
| JP | 2002-189385 | A | 7/2002 |
| JP | 2006039036 | A * | 2/2006 |

* cited by examiner

*Primary Examiner* — Robert Beatty
(74) *Attorney, Agent, or Firm* — Rossi, Kimms & McDowell LLP

(57) ABSTRACT

An image forming apparatus comprises: a counting unit which counts the number of pixels at each tone level in a halftone image corresponding to an input image; a determination unit which determines a halftone region in the halftone image; an acquisition unit which acquires tone characteristic information of an output density of the image forming apparatus; a correction unit which obtains a density in a region to be formed by using a developing material from the number of pixels at each of the tone levels and information of the halftone region and correct the density in accordance with the tone characteristic information; and a first prediction unit which predicts a consumption amount of the developing material by using the density corrected by the correction unit.

6 Claims, 9 Drawing Sheets

IMAGE FORMING APPARATUS WITH CONSUMPTION PREDICTION, METHOD OF CONTROLLING THE SAME, AND NON-TRANSITORY COMPUTER-READABLE MEDIUM

BACKGROUND OF THE INVENTION

1. Field of the Invention

The present invention relates to an image forming apparatus, a method of controlling the same, and a non-transitory computer-readable medium, and more particularly, to a technique for predicting, from an image signal, the amount of developing material to be consumed when printing an image by using a developing material based on the image signal.

2. Description of the Related Art

In general, for electrophotographic and electrostatic recording image forming apparatuses, properly supplying a developing material is a function necessary to maintain good image output. Color image forming apparatuses often use a developing material constituted by two components (two-component developing material) containing a magnetic powder called carrier particles in addition to toner particles as a coloring material in consideration of color reproducibility. For an image forming apparatus using a two-component developing material, the toner density of the developing material (that is, the ratio of a toner particle weight to the total weight of carrier and toner particles) is a very important factor for the stabilization of image quality. Since toner particles of a two-component developing material are consumed at the time of developing, the toner density changes. For this reason, it is necessary to control the toner density to always keep it constant so as to hold the quality of images by supplying toner in accordance with a change in toner density.

Conventional density controllers for controlling toner density include, for example, one that detects the density of developed toner by using various types of sensors. On the other hand, there has been developed a unit for calculating the amount of toner without using various types of sensors. A density controller based on a so-called video count method has been proposed as a controller used in a digital image forming apparatus, in particular. This method is configured to keep the toner density in a developing device constant by calculating a video count from an input multilevel image signal and deciding a toner supply amount upon predicting a toner consumption amount from the video count.

A problem of this technique is, however, that it requires a multivalued image signal and hence cannot cope with a case in which a halftone image signal representing the dot distribution of toner particles on a paper medium is directly supplied to an image forming apparatus.

In order to solve the above problem, there has been proposed a technique of predicting a toner consumption amount from a halftone image signal. For example, Japanese Patent Laid-Open No. 9-22226 discloses a technique of calculating the amount of toner consumed by counting the output signals of a halftone image and obtaining the product of the accumulated count value and the adhesion amount of toner per dot. In addition, Japanese Patent Laid-Open No. 2002-189385 discloses a technique of detecting a continuous dot count from a continuous output signal count and calculating a toner consumption amount after a series of dot formation based on data associating continuous dot counts with the representative values of toner consumption amounts.

The problem of incapability of coping with a change in the output density characteristics of an engine arises in the method of calculating a toner consumption amount, upon weighting a dot count value, such as the adhesion amount of toner per dot or the representative value for the continuous dot count as in the above technique. Assume that the output density characteristics of an image forming apparatus deteriorate due to an environmental change or temporal change. In this case, even if the apparatus receives halftone image signals with the same pattern, the density characteristics of printed products to be output deteriorate. This indicates that the toner consumption amount has decreased and the adhesion amount of toner per dot or the representative value for the continuous dot count change.

SUMMARY OF THE INVENTION

The present invention provides a technique of predicting a toner consumption amount based on a halftone image, which is robust against the influence of variations in output density characteristics and can predict a toner consumption amount with high accuracy.

According to one aspect of the present invention, there is provided an image forming apparatus comprising: a counting unit configured to count the number of pixels at each tone level in a halftone image corresponding to an input image; a determination unit configured to determine a halftone region in the halftone image; an acquisition unit configured to acquire tone characteristic information of an output density of the image forming apparatus; a correction unit configured to obtain a density in a region to be formed by using a developing material from the number of pixels at each of the tone levels and information of the halftone region and correct the density in accordance with the tone characteristic information; and a first prediction unit configured to predict a consumption amount of the developing material by using the density corrected by the correction unit.

According to another aspect of the present invention, there is provided a method of controlling an image forming apparatus, the method comprising: a counting step of counting the number of pixels at each tone level in a halftone image corresponding to an input image; a determination step of determining a halftone region in the halftone image; an acquisition step of acquiring tone characteristic information of a density at the time of outputting from the image forming apparatus; a correction step of obtaining a density in a region to be formed by using the developing material from the number of pixels at each of the tone levels and information of the halftone region and correcting the density in accordance with the tone characteristic information; and a prediction step of predicting a consumption amount of the developing material by using the density corrected in the correction step.

According to another aspect of the present invention, there is provided a non-transitory computer-readable medium storing a program for causing a computer to function as a counting unit configured to count the number of pixels at each tone level in a halftone image corresponding to an input image, a determination unit configured to determine a halftone region in the halftone image, an acquisition unit configured to acquire tone characteristic information of a density at the time of outputting from the image forming apparatus, a correction unit configured to obtain a density in a region to be formed by using a developing material from the number of pixels at each of the tone levels and information of the halftone region and correct the density in accordance with the tone characteristic information, and a prediction unit configured to predict a consumption amount of the developing material by using the density corrected by the correction unit.

The present invention enables to predict a developing material consumption amount with high accuracy and robustness against the influence of variations in output density characteristics.

Further features of the present invention will become apparent from the following description of exemplary embodiments (with reference to the attached drawings).

DESCRIPTION OF THE EMBODIMENTS

<First Embodiment>

(System Configuration)

Figure 1:
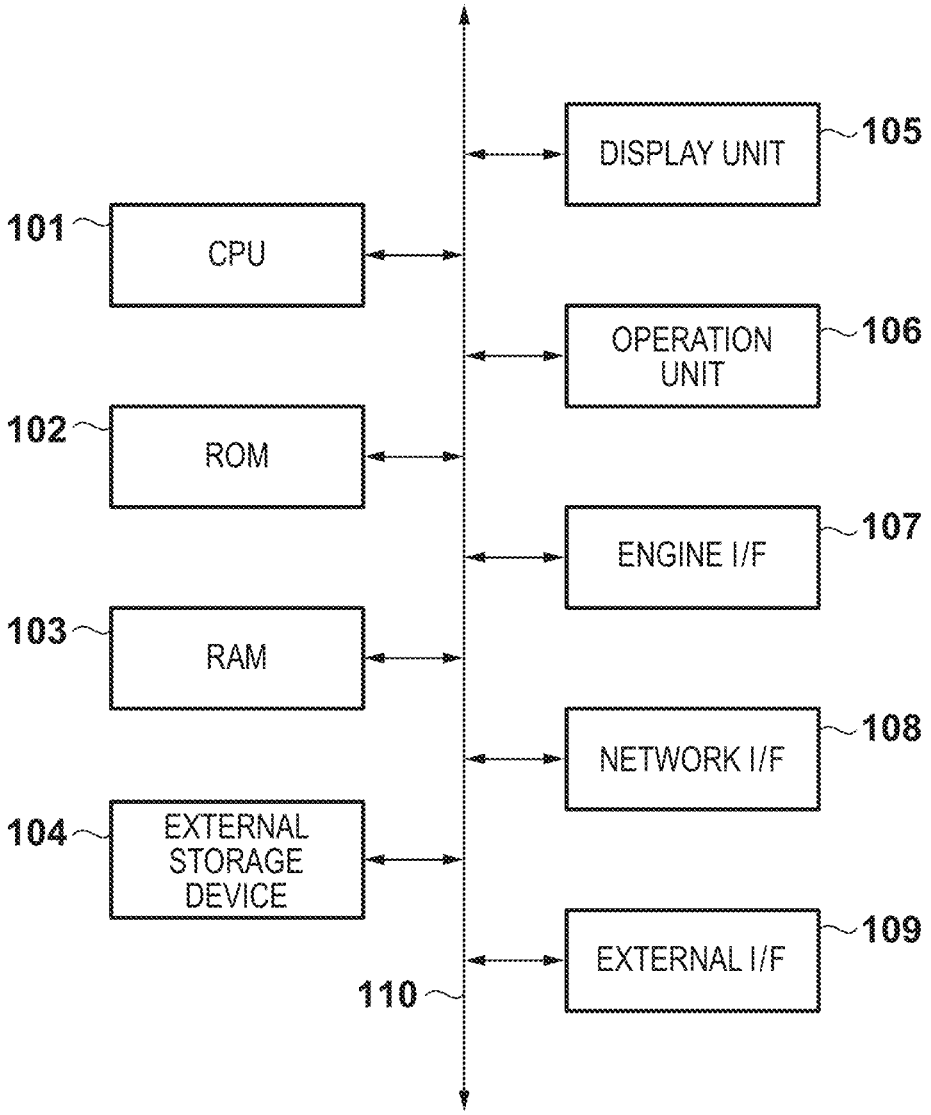
FIG. 1 is a block diagram showing the basic arrangement of an image forming apparatus according to the first embodiment.

FIG. 1 is a block diagram showing an example of the basic hardware arrangement of an image forming apparatus according to an embodiment. The image forming apparatus has a plurality of functions such as an image reading function, image forming function, and image communication function. Executing the respective functions can execute a print job to form an image on a printing medium and a scan job to read an image from a document. It is also possible to execute various types of jobs such as a fax job to perform image communication with an external apparatus and a copy job to form the image read from a document on a printing medium. The image forming apparatus includes a CPU 101, a ROM 102, a RAM 103, an external storage device 104, a display unit 105, an operation unit 106, an engine I/F 107, a network I/F 108, an external I/F 109, and a system bus 110.

The CPU 101 is a central processing unit which controls the overall image forming apparatus and performs arithmetic processing and the like. The CPU 101 executes, based on the programs stored in the ROM 102, each process according to this embodiment to be described later. The ROM 102 is a read only memory, which is a storage area for a boot program for starting up the image forming apparatus, a program for controlling the printer engine, character data, and character code information, and the like.

The RAM 103 is a random access memory, in which font data additionally registered by downloading is stored and a program and data are loaded and executed for each of various types of processes. It is possible to use the RAM 103 as a data storage area for received image data. The external storage device 104 is formed from, for example, a hard disk, which is used to spool data, store programs, various types of information files, image data, and attribute signals, and the like, and is used as a work area.

The display unit 105 performs display operation by using liquid crystals or the like and is used to display the set state of the apparatus, current processing inside the apparatus, an error state, and the like. The operation unit 106 is used to change and reset settings and can display an operation window and the like for print settings at the time of output, together with the display unit 105. The engine I/F 107 is an interface which actually exchanges commands and the like for control on a printer engine 202 and toner supply. The network I/F 108 is an interface for connecting the image forming apparatus to a network. The external I/F 109 is connected to a host computer via, for example, a parallel or serial interface. The system bus 110 connects the above constituent elements to each other and serves as a data path between them.

Figure 2:
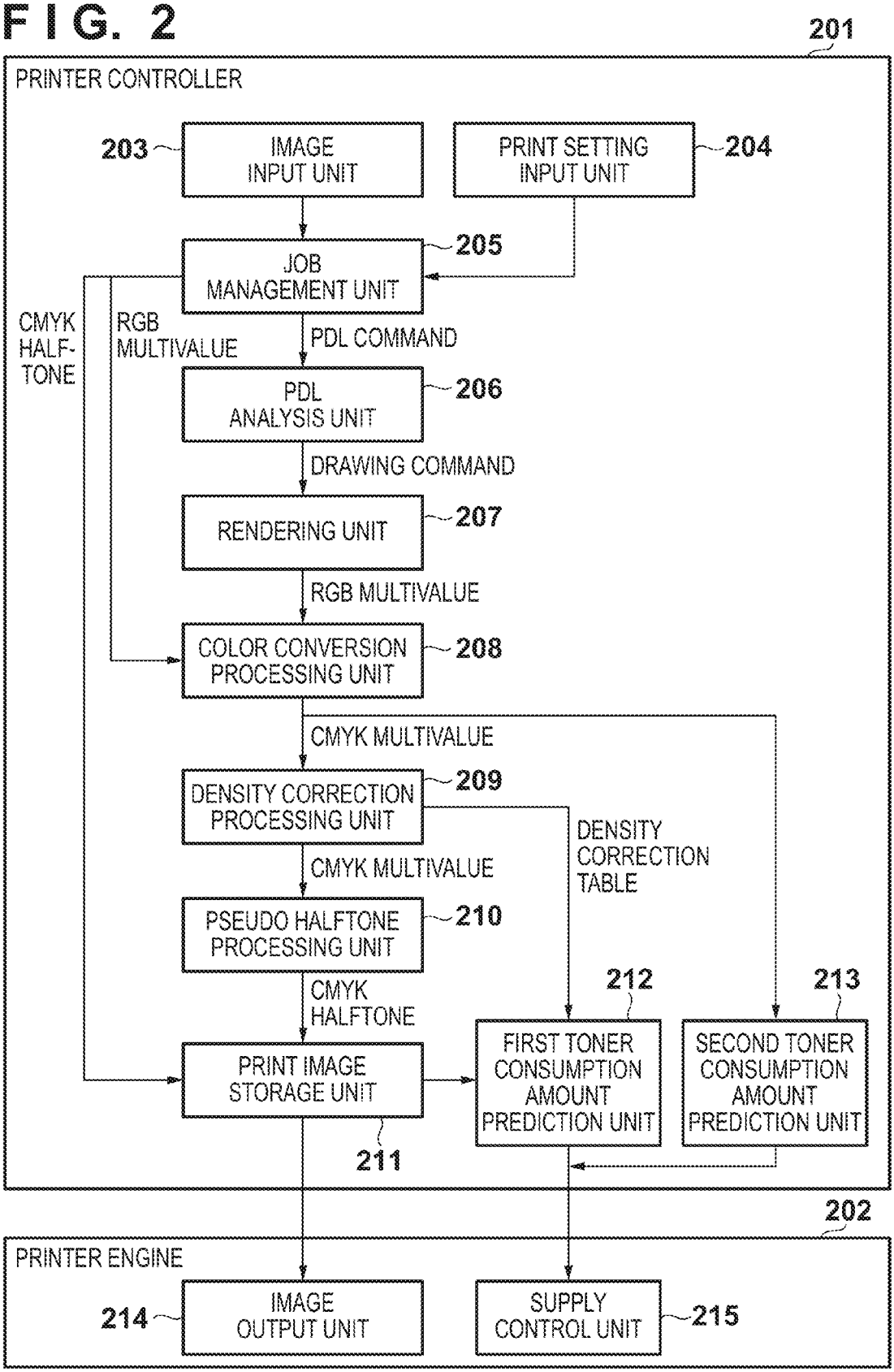
FIG. 2 is a block diagram showing the functional arrangement of the image forming apparatus according to the first embodiment.

FIG. 2 is a block diagram showing an example of the functional arrangement of the image forming apparatus according to this embodiment. A printer controller 201 includes an image input unit 203, a print setting input unit 204, a job management unit 205, a PDL analysis unit 206, a rendering unit 207, a color conversion processing unit 208, a density correction processing unit 209, a pseudo halftone processing unit 210, a print image storage unit 211, a first toner consumption amount prediction unit 212, and a second toner consumption amount prediction unit 213. The printer engine 202 includes an image output unit 214 and a supply control unit 215. The print image storage unit 211 holds a halftone image. When the print image storage unit 211 transfers the halftone image to the image output unit 214, the image output unit 214 performs print processing. In addition, the predicted value of the amount of developing material (toner) consumption amount generated by the first toner consumption amount prediction unit 212 (first prediction unit) or the second toner consumption amount prediction unit 213 (second prediction unit) is input to the supply control unit 215. The supply control unit 215 controls the amount of toner supplied to the developing device based on the predicted value.

Image data to be printed is input to the image input unit 203. The image input unit 203 can receive image data transmitted from an information processing apparatus (host PC) (not shown) and image data transmitted from a fax machine via, for example, the network I/F 108. The image input unit 203 can also receive, as input data, image data read by a scanner or the like (not shown) in accordance with a scan job. In addition, some apparatus is configured to designate image data stored in the external storage device 104 in advance and input the data to the image input unit 203. That is, the present invention is not specifically limited to any input method for image data.

Described first will be operation to be performed when input image data is written in a PDL (Page Description Language) for generating page image data called a PDL command. The job management unit 205 sends a PDL command to the PDL analysis unit 206. The PDL analysis unit 206 interprets the PDL command and sends the drawing command to the rendering unit 207. The rendering unit 207 writes a bitmap image based on the drawing command and sends the multilevel image data of the RGB image to the color conversion processing unit 208.

The color conversion processing unit 208, the density correction processing unit 209, and the pseudo halftone processing unit 210 perform various types of image processing for image data and convert the data into an image format that can be output from the image output unit 214. In this case, assume that the image output unit 214 has received image data corresponding to developing materials of four colors including cyan (C), magenta (M), yellow (Y), and black (K). The color conversion processing unit 208 converts the bitmap image in the RGB color space written by the rendering unit 207 into a density image in the CMYK color space by using a lookup table (LUT) or the like. The density image generated in this case is CMYK data with each pixel taking a multilevel. Obviously, a density image need not always be CMYK data depending on the type of developing material.

The density correction processing unit 209 then corrects the density tones of the image in accordance with tone characteristics with respect to the output densities of the printer engine 202, and sends the corrected image to the pseudo halftone processing unit 210. In general, density correction is performed by using an LUT defined as a density correction table. The density correction table and density correction table generation processing will be described in detail later.

In general, the image output unit 214 is often capable of outputting only a small number of tone levels such as 2, 4, or 16 tone levels. The pseudo halftone processing unit 210 therefore performs pseudo halftone processing to allow even the image output unit 214 capable of outputting only a small number of tone levels to implement a stable halftone expression. The pseudo halftone processing unit 210 converts the density image into a halftone image by performing pseudo halftone processing for the image, and transmits the image to the print image storage unit 211. The print image storage unit 211 transfers the received halftone image as a video signal to the image output unit 214 via the engine I/F 107. The image output unit 214 then executes print processing.

(Density Correction Table Generation Processing)

Figure 3:
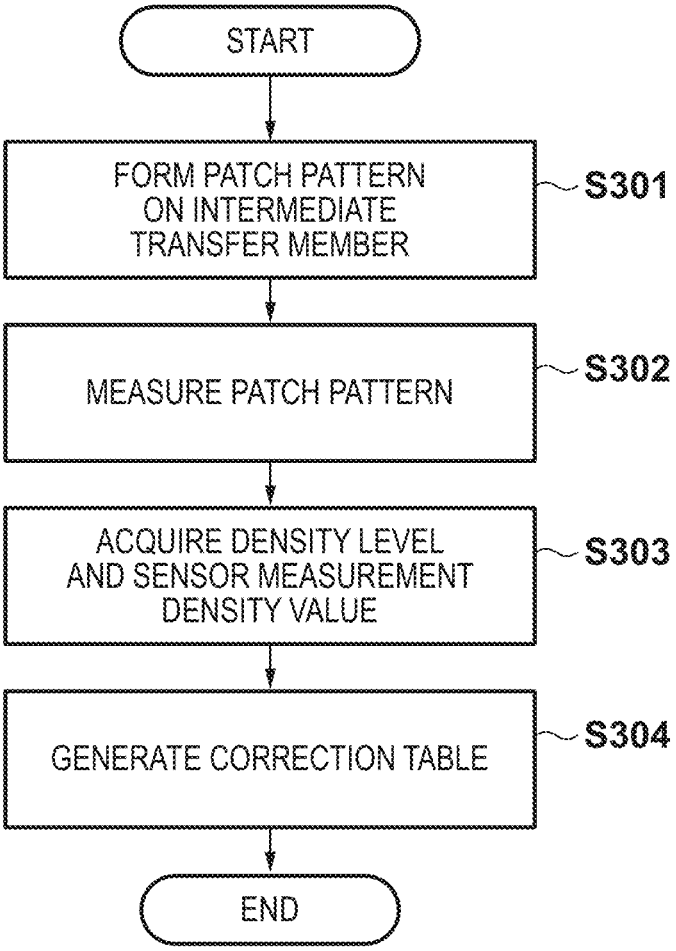
FIG. 3 is a flowchart showing a procedure for density correction table generation processing.
Figure 4:
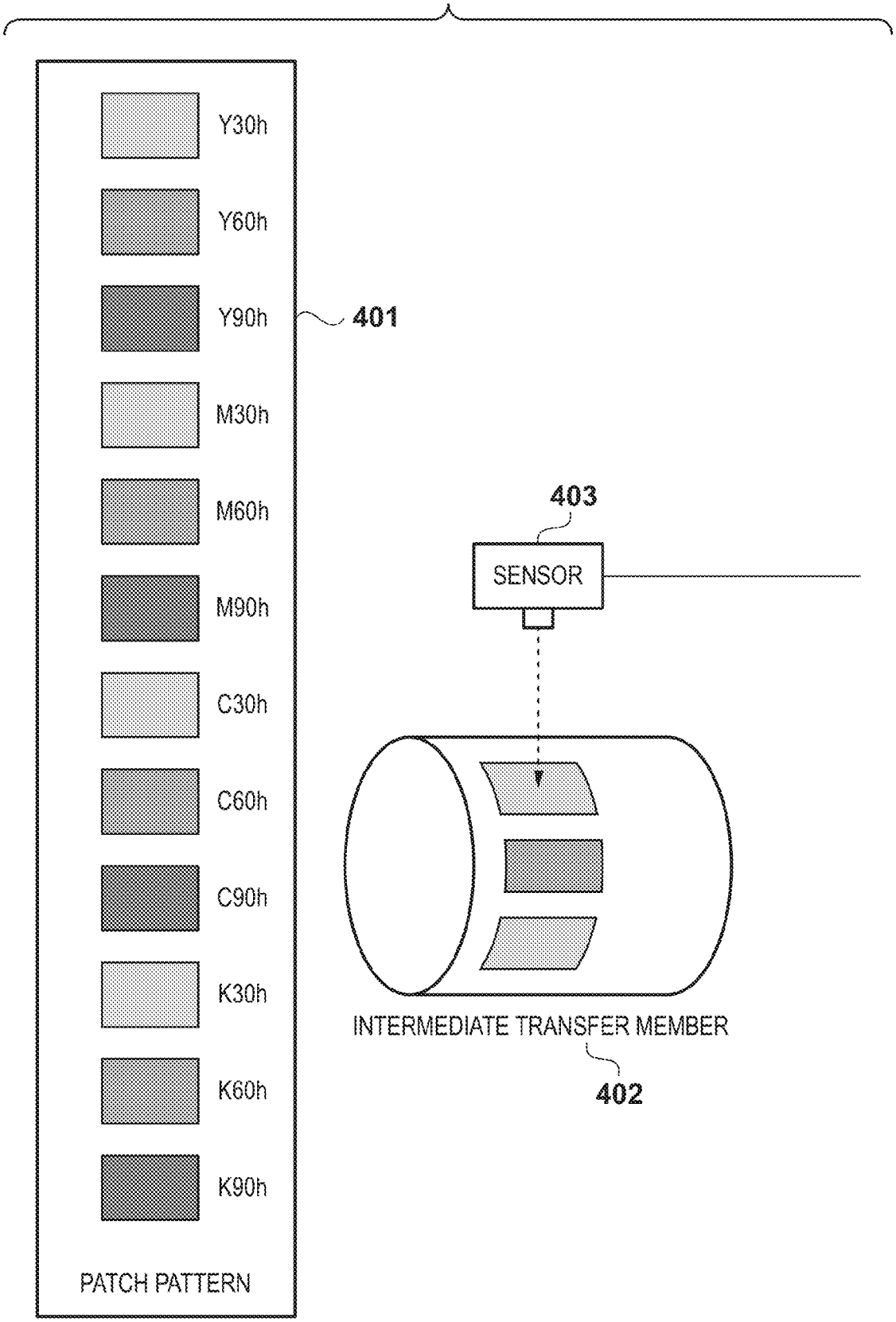
FIG. 4 is a view showing the manner of performing density measurement processing at the time of the generation of a density correction table.

FIG. 3 is a flowchart showing a procedure for density correction table generation processing. The CPU 101 implements the processing indicated by the flowchart by executing the program stored in the ROM 102 and temporarily loaded into the RAM 103. FIG. 4 is a view showing the manner of performing density measurement processing at the time of the generation of a density correction table. Processing operation for the generation of a density correction table in this embodiment will be described below with reference to FIGS. 3 and 4.

A patch pattern 401 shown in FIG. 4 shows an example of a patch pattern of halftone density levels at several arbitrary points from density level 0 to density level 255 concerning the respective colors C, M, Y, and K. The patch pattern 401 is actually transferred onto an intermediate transfer member 402. A sensor 403 measures densities from the patch pattern 401. In the example shown in FIG. 4, the patch pattern 401 has density levels 30H, 60H, and 90H (where H represents a hexadecimal number) of each of the respective colors C, M, Y, and K.

When generating a density correction table, first of all, the CPU 101 forms the patch pattern 401 on the intermediate transfer member 402 (step S301). The CPU 101 then measures the densities of the patch pattern 401 by using the sensor 403 (step S302). The CPU 101 acquires the density levels of the formed path pattern 401 and the sensor measurement density values measured in step S302 (step S303). The CPU 101 generates a density correction table, with density characteristics corresponding to input density levels exhibiting specified density characteristics, by using the acquired sensor measurement density values of the respective density levels (step S304). The CPU 101 then terminates the processing.

Figure 5A:
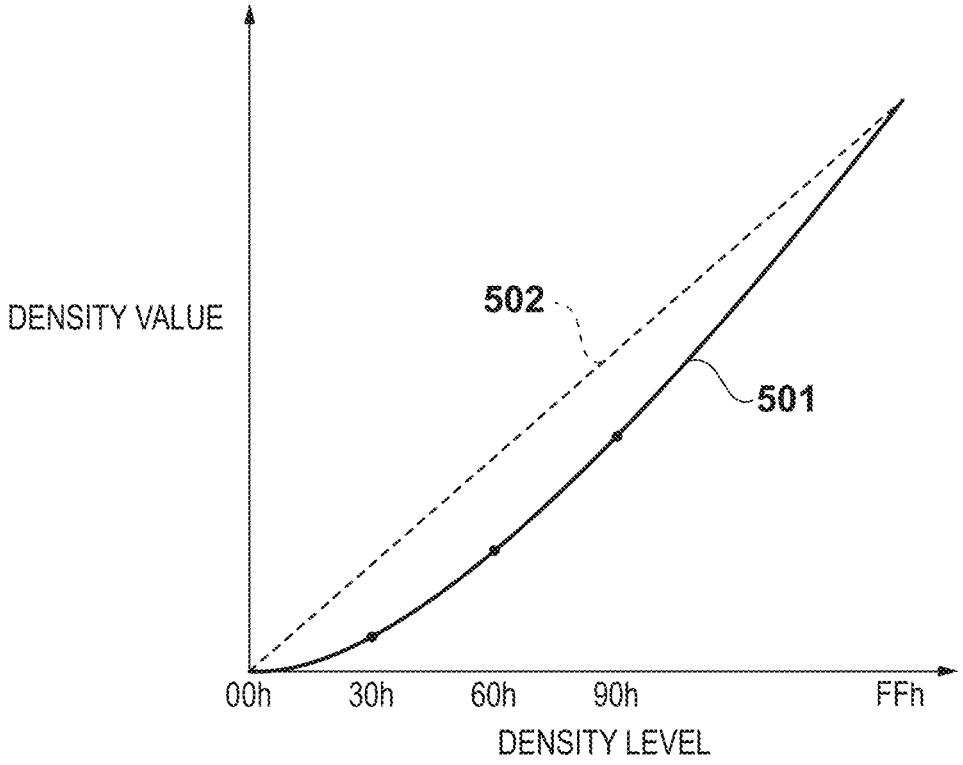
FIGS. 5A and 5B are graphs for explaining a density correction table.
Figure 5B:
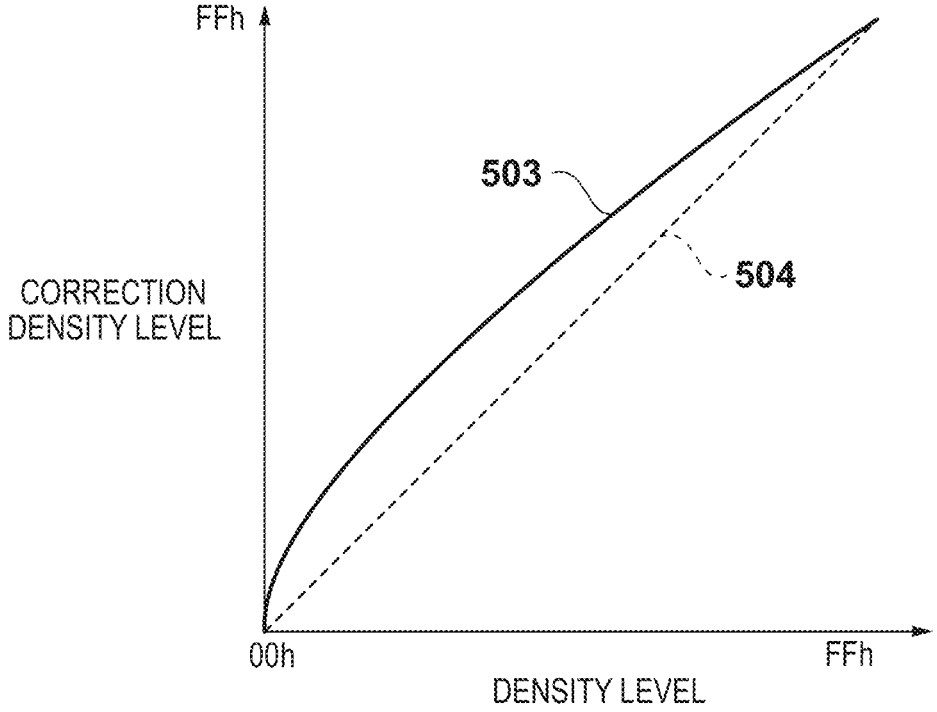

FIGS. 5A and 5B are graphs for explaining a density correction table. Referring to FIG. 5A, the ordinate indicates density value, and the abscissa indicates density level. In this case, the respective patches indicated by the patch pattern 401 are shown in correspondence with the density levels. A solid line 501 in FIG. 5A indicates density characteristics corresponding to the input density levels obtained from the measurement values measured by the sensor 403 upon formation of the patch pattern 401 described in steps S301 to S303 in FIG. 3. A broken line 502 in FIG. 5A indicates specified density characteristics determined in advance, which exemplifies, in this case, the characteristics in which the relationship between the input density levels and the density characteristics is linear.

Referring to FIG. 5B, the ordinate indicates corrected density level, and the abscissa indicates density level. A solid line 503 in FIG. 5B indicates an actually generated density correction table. Using this can correct the density characteristics indicated by the solid line 501 in FIG. 5A into specified density characteristics like those indicated by a broken line 504 in FIG. 5B. Although the processing shown in FIG. 3 has exemplified the processing of generating a density correction table, if a density correction table has already been set, it is possible to perform the processing of updating the table by using a newly generated density correction table. The processing procedure shown in FIG. 3 can also be applied to the processing of updating a density correction table.

If input image data is a PDL command, a toner consumption amount is predicted based on a density image in the CMYK color space which has undergone color conversion processing. The second toner consumption amount prediction unit 213 analyzes the density image in the CMYK color space, which has been converted by the color conversion processing unit 208, and calculates a toner consumption amount per printing medium. Methods of calculating a toner consumption amount for each image data include a method of obtaining a toner consumption amount as an accumulated value proportional to each pixel value of a density image and a method of accumulating values obtained by weighting pixel values in accordance with image characteristics for higher accuracy. When the second toner consumption amount prediction unit 213 transmits the predicted value of a toner consumption amount to the supply control unit 215, the supply control unit 215 supplies toner to the printer engine 202.

If the data received by the job management unit 205 is RGB image data such as the image data read by an image reading apparatus, since there is no need to perform PDL analysis and rendering, the color conversion processing unit 208 starts processing first. In this case, as in the case in which the input image data is a PDL command, the second toner consumption amount prediction unit 213 predicts a toner consumption amount.

In contrast, if the data received by the job management unit 205 is the halftone image data generated by the host computer or FAX data, since the image data has already been halftoned, the data is directly transmitted to the print image storage unit 211. The print image storage unit 211 transfers the received halftone image as a video signal to the image output unit 214 via the engine I/F 107. The image output unit 214 then executes print processing.

At the same time, the halftone image is transmitted to the first toner consumption amount prediction unit 212. The first toner consumption amount prediction unit 212 calculates the predicted value of a toner consumption amount. When the first toner consumption amount prediction unit 212 transmits the predicted value of the toner consumption amount to the supply control unit 215, the supply control unit 215 supplies toner to the printer engine 202.

(Toner Consumption Amount Prediction Processing)

Figure 6:
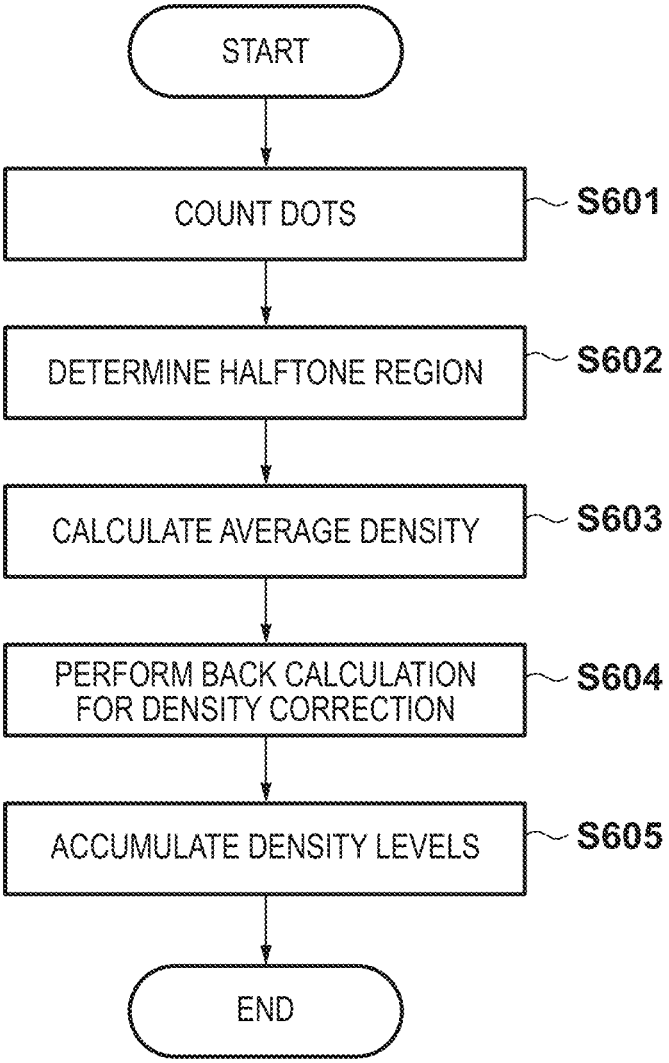
FIG. 6 is a flowchart for toner consumption amount prediction processing by a first toner consumption amount prediction unit according to the first embodiment.

A mechanism for toner consumption amount prediction method used by the first toner consumption amount prediction unit 212 will be described. FIG. 6 is a flowchart for toner consumption amount prediction processing by the first toner consumption amount prediction unit 212 according to this embodiment.

First of all, the first toner consumption amount prediction unit 212 accepts a halftone image from the print image storage unit 211. The first toner consumption amount prediction unit 212 then performs the dot count processing of counting the number of pixels per tone level in each developing material concerning the halftone image (step S601). Table 1 shows an example of the counts acquired by dot count processing.

TABLE 1

| Tone | Number of pixels [pix] | | | |
|---|---|---|---|---|
| Level | C | M | Y | K |
| 0 | 32837243 | 32608965 | 32666336 | 33120154 |
| 1 | 297710 | 164227 | 160674 | 160776 |
| 2 | 80959 | 102440 | 347339 | 49802 |
| 3 | 1702488 | 2042768 | 1744051 | 1587668 |

Table 1 shows an example of the data obtained by performing 4-tone (2-bit) pseudo halftone processing for 600-dpi A4 image data. As shown in Table 1, the first toner consumption amount prediction unit 212 counts the numbers of pixels at the four tone levels concerning each of the colors C, M, Y, and K. The first toner consumption amount prediction unit 212 then extracts an image region (halftone region) expressed as halftone data from the result obtained by performing pseudo halftone processing for the input halftone image (step S602).

Figure 7A:
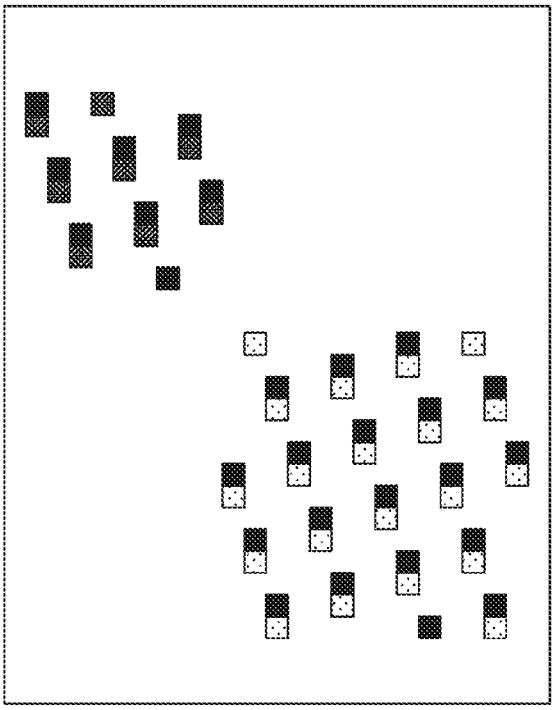
FIGS. 7A, 7B, and 7C are views showing an outline of halftone region determination processing.
Figure 7B:
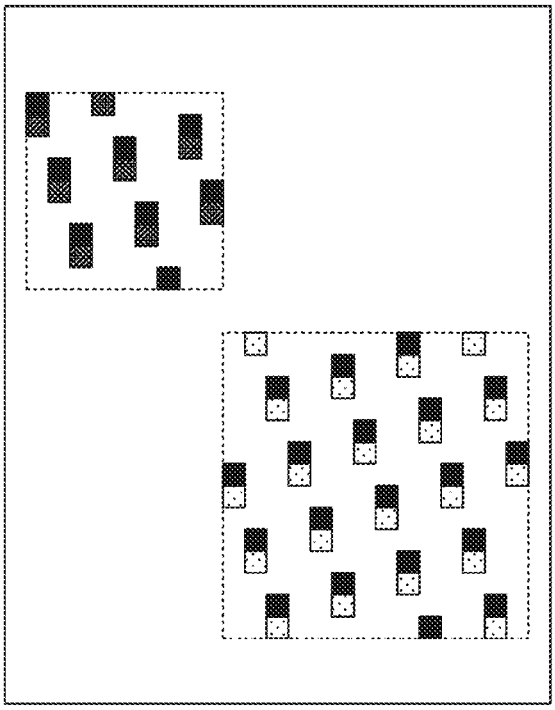
Figure 7C:
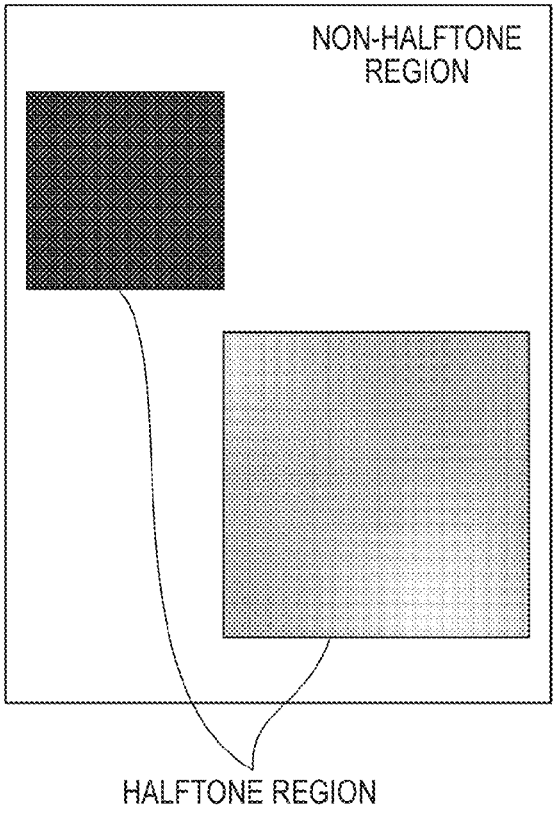

FIGS. 7A to 7C show an outline of determination processing for the halftone region performed in halftone region determination processing (step S602). FIG. 7A shows an example of a halftone image input to the first toner consumption amount prediction unit 212. As shown in FIG. 7A, pseudo halftone processing has been performed for regions to be drawn. FIG. 7B shows a case in which halftone region determination processing (step S602) is performed to determine halftone regions in a halftone image. Note that halftone region determination units using various techniques have been conventionally proposed, such as a unit using pattern matching. The halftone region determination unit in this embodiment is not limited to any specific method. Note however that pattern matching requires patterns for matching and a line buffer. For this reason, in order to implement a more inexpensive method, it is preferable to use a technique using a run length method which enables halftone region determination. FIG. 7C shows the result obtained when halftone region determination processing (step S602) is performed to determine halftone regions and a non-halftone region. In this embodiment, in halftone region determination processing (step S602), the first toner consumption amount prediction unit 212 counts the numbers of pixels in portions determined as halftone regions after halftone region determination.

The first toner consumption amount prediction unit 212 then performs average density calculation processing (step S603). The first toner consumption amount prediction unit 212 calculates an average density which is the average value of the density values in a region to be printed in a halftone image by using the dot count value obtained by dot count processing (step S601) and the numbers of pixels in the halftone region obtained in halftone region determination processing (step S602).

First of all, the first toner consumption amount prediction unit 212 obtains the accumulated value of density levels by using the dot count values obtained in dot count processing (step S601). In this case, the accumulated value of density levels indicates the sum total of the values of density levels of the respective pixels in an image. If a density image for which the density correction processing unit 209 in FIG. 2 performs density correction is a 256-tone (8-bit) image, each tone level is converted into an 8-bit density level. That is, tone levels 0, 1, 2, and 3 are respectively converted into density levels 0, 85, 170, and 255. Letting a0, a1, a2, and a3 be the numbers of pixels counted concerning tone levels 0, 1, 2, and 3, the first toner consumption amount prediction unit 212 obtains the accumulated value of density values by $$\text{accumulated value of density levels} = 0\times a0 + 85\times a1 + 170\times a2 + 255\times a3 \quad (1)$$

Dividing the accumulated value of density levels obtained by the above equation by the number of pixels in the halftone region, which is counted in halftone region determination processing (step S602), can calculate an average density level in a region to be printed in the input halftone image.

The average density level obtained in this case is information equivalent to the density levels to which the density correction processing described with reference to FIG. 2 is applied. That is, this information is a density level influenced by variations in output density characteristics. The first toner consumption amount prediction unit 212 therefore performs back calculation processing for density correction (step S604). In this case, the first toner consumption amount prediction unit 212 calculates a density level free from the influence of the output density characteristics (that is, information equivalent to the density level output from the color conversion processing unit 208) by using the density correction table used by the density correction processing unit 209.

Figure 8:
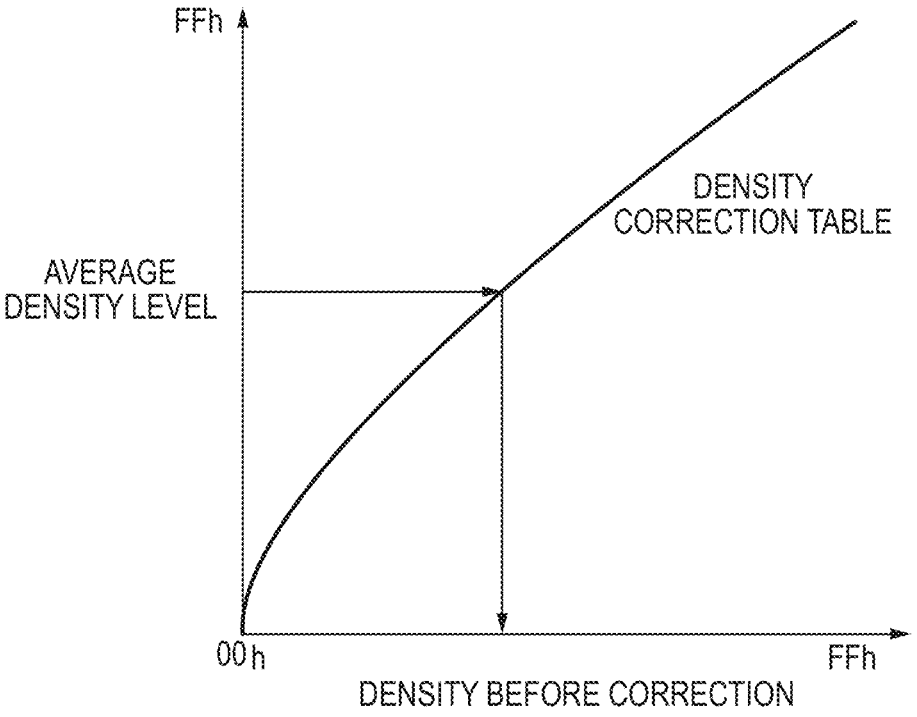
FIG. 8 is a graph showing a concept concerning density level back calculation processing.

FIG. 8 shows a concept concerning density level back calculation processing performed in step S604. The density correction table has the same characteristics as those shown in FIG. 5B. Referring to FIG. 8, the ordinate indicates average density level, and the abscissa indicates density before correction. As described above, the density correction table is used to calculate a density level after the application of correction with respect to a given input density level. As shown in FIG. 8, therefore, it is possible to calculate a density level before correction from a density level after correction.

It is possible to calculate a density level without being influenced by variations in output density characteristics by calculating a density level before correction from the density correction table with respect to the average density level calculated by average density calculation processing (step S603).

The first toner consumption amount prediction unit 212 calculates the product of the average density level free from variations in output density characteristics, calculated by density correction back calculation processing (step S604), and the number of pixels in the halftone region, which is obtained by halftone region determination processing (step S602), (step S605). This makes it possible to obtain the accumulated value of the density levels of the input image and calculate the predicted value of a toner consumption amount per printing medium.

(Effects of Embodiment)

Effects of the technique of this embodiment will be described below. Table 2 shows the errors between the accumulated values of density levels calculated from the dot count values obtained by dot count processing (step S601) and the accumulated values of a density image before the application of density correction processing and pseudo halftone processing in this embodiment.

TABLE 2

| | | Error [%] | | | |
|---|---|---|---|---|---|
| | | C | M | Y | K |
| Image 1 | Density level accumulation | 15.63 | 18.48 | 20.83 | 8.11 |
| | Technique of Embodiment | 3.63 | 0.14 | 0.9 | 3.23 |
| Image 2 | Density level accumulation | 13.84 | 15.06 | 15.25 | 13.87 |
| | Technique of Embodiment | 0.69 | 0.51 | 0.64 | 1.31 |
| Image 3 | Density level accumulation | 12.55 | 14.98 | 14.7 | 12.85 |
| | Technique of Embodiment | 0.9 | 1.21 | 1.33 | 2.5 |

According to Table 2, the density levels obtained by a dot count unit 601 are those influenced by variations in output density characteristics, which include many errors relative to an actual density image. In contrast to this, obviously, the technique of this embodiment reduces errors by correcting the influence of variations in output density characteristics.

(Toner Consumption Amount Prediction Execution Control)

Although the first toner consumption amount prediction unit 212 and the second toner consumption amount prediction unit 213 perform toner consumption amount prediction in this embodiment, the job management unit 205 performs control, based on the image data input to the image input unit 203, to cause one of the units to perform the prediction.

Figure 9:
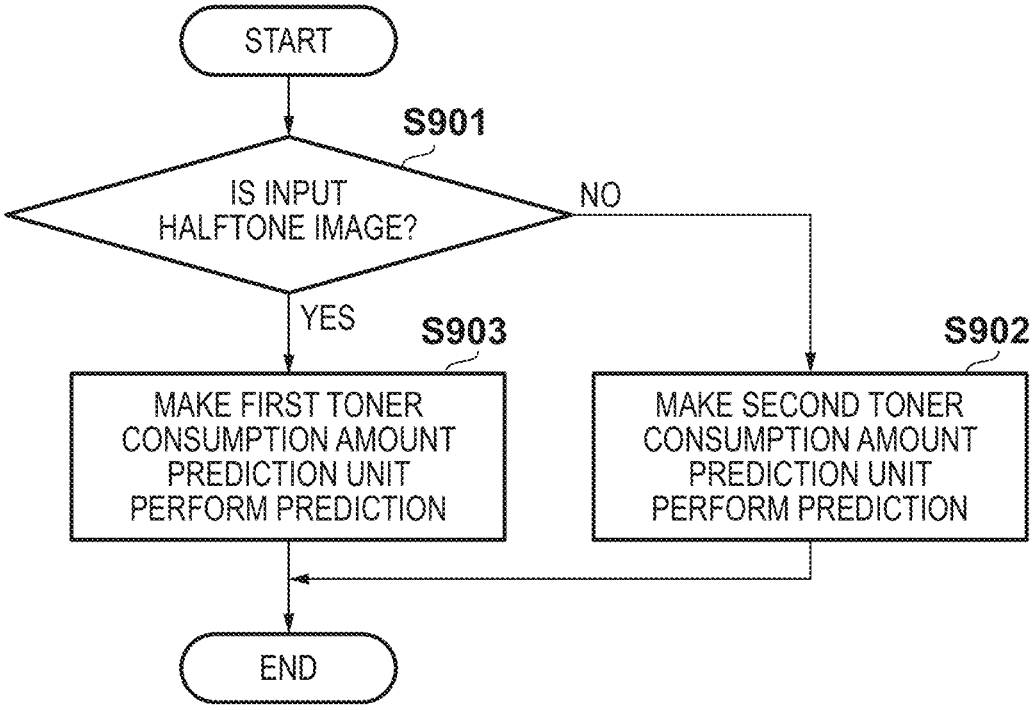
FIG. 9 is a flowchart for the determination of the execution of toner consumption amount prediction.

FIG. 9 is a flowchart when the job management unit 205 executes control for toner consumption amount prediction. In step S901, the job management unit 205 determines whether input image data is a halftone image. In this case, halftone images include a halftone image generated by the host computer and a received image based on FAX data. Examples of images other than halftone images include a PDL command which makes it necessary for input image data to be rendered and RGB image data read by the image reading apparatus. If the input image data is not a halftone image (NO in step S901), the job management unit 205 performs control to make the second toner consumption amount prediction unit 213 execute toner consumption amount prediction (step S902). In contrast, if the input image data is a halftone image (YES in step S901), the job management unit 205 performs control to make the first toner consumption amount prediction unit 212 execute toner consumption amount prediction (step S903).

This makes it possible to apply the prediction of a toner consumption amount from conventional multilevel image data to a multilevel image and perform toner consumption amount prediction concerning a halftone image.

According to the technique of this embodiment, when predicting a toner consumption amount based on a halftone image, the apparatus obtains an average density in a portion to be drawn in print data and then calculates density information before density correction based on correction information of output density characteristics. This makes it possible to implement toner consumption amount prediction with high accuracy and high robustness against the influence of variations in output density characteristics.

<Second Embodiment>

In the first embodiment, if input image data is a halftone image, it is necessary to determine a halftone region in the image data which is to be processed by the first toner consumption amount prediction unit 212 to predict a toner consumption amount. This operation is required to obtain an average density in a print region in the image data. On the other hand, it is known that when the density levels of image data are high in an electrophotographic image forming apparatus, prediction is robust against the influence of variations in output density characteristics, it is therefore possible to predict a toner consumption amount even from the accumulated value of density levels. That is, this eliminates the necessity of halftone region determination and density correction processing. The second embodiment will exemplify an arrangement which can switch halftone region determination processing and accompanying back calculation processing for density correction depending on the accumulated value of density levels when predicting a toner consumption amount.

Figure 10:
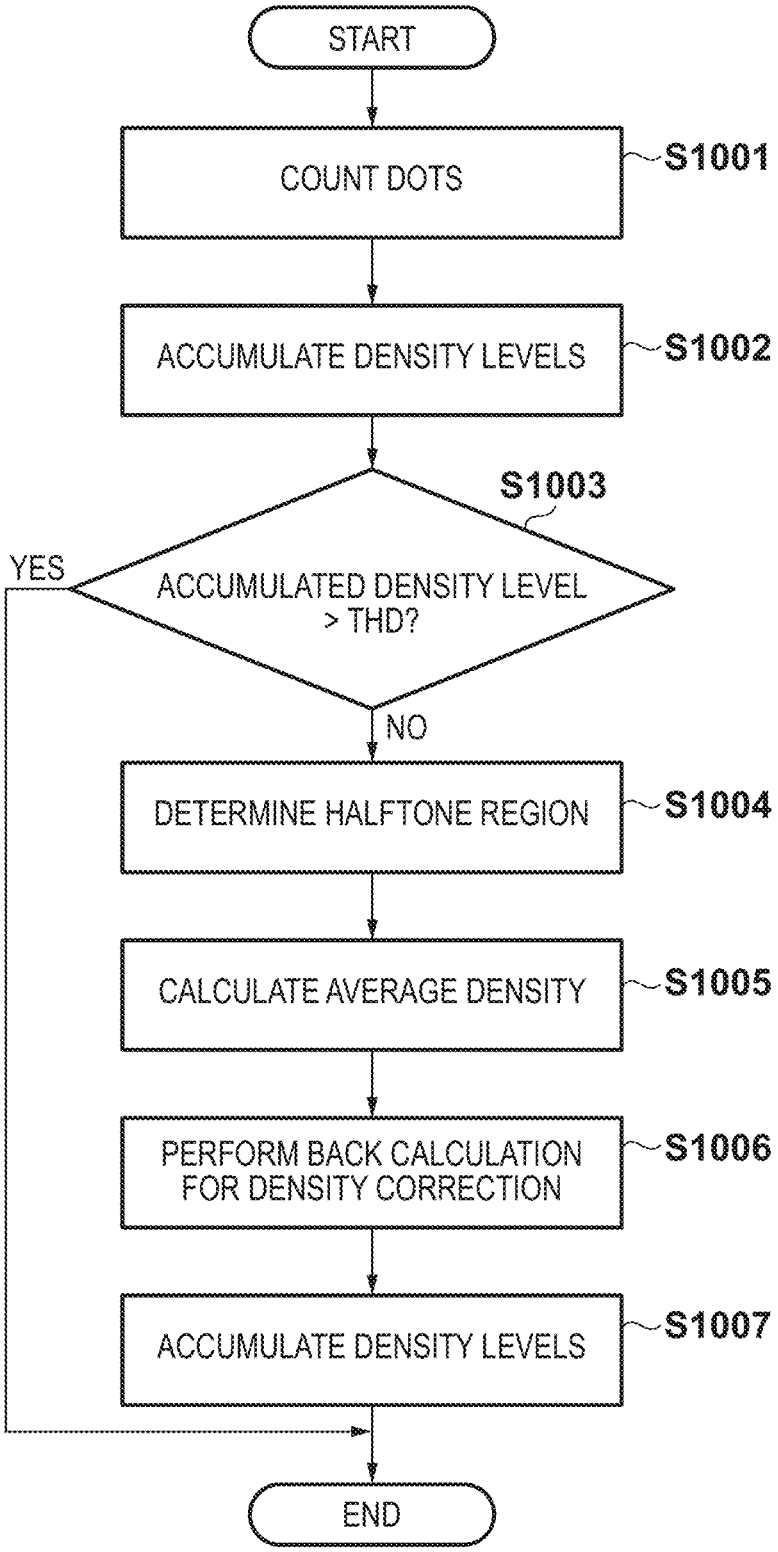
FIG. 10 is a flowchart for toner consumption amount prediction processing by a first toner consumption amount prediction unit according to the second embodiment.

An example of the arrangement of an image forming apparatus according to this embodiment is the same as that in the first embodiment shown in FIG. 2. On the other hand, processing performed by a first toner consumption amount prediction unit 212 in FIG. 2 differs from that in the first embodiment. FIG. 10 is a flowchart for toner consumption amount prediction by the first toner consumption amount prediction unit 212 according to this embodiment.

In step S1001, the first toner consumption amount prediction unit 212 performs the dot count processing of counting the number of pixels at each tone level with respect to each developing material concerning a halftone image. In step S1002, the first toner consumption amount prediction unit 212 then converts each tone level into a density level and obtains the accumulated value of density levels. The first toner consumption amount prediction unit 212 may use the same method as that in the first embodiment to calculate the accumulated value of density levels.

In step S1003, the first toner consumption amount prediction unit 212 determines whether the obtained accumulated value of the density levels is larger than a predetermined threshold (THD). If the accumulated value of the density levels is smaller than a given threshold, the first toner consumption amount prediction unit 212 predicts that the average density of the input image data is low or the input image data is data having a high average density and a narrow region to be drawn. In contrast, if the accumulated density level is larger than a given threshold, it is known that the average density of the input image data is high.

If the accumulated value of the density levels is higher than the threshold (YES in step S1003), it is possible to predict a toner consumption amount even by using the accumulated value of the density levels obtained by dot counting. The first toner consumption amount prediction unit 212 therefore uses the accumulated value of the density levels as the predicted value of a toner consumption amount, and terminates the processing. If the accumulated value of the density levels is equal to or less than the threshold (NO in step S1003), the process shifts to step S1004. The processing in steps S1004 to S1007 is the same as that in steps S602 to S605 in the first embodiment, and hence a detailed description of the processing will be omitted.

According to the technique of this embodiment, when predicting a toner consumption amount based on a halftone image, the apparatus performs data analysis processing for an input image. In this case, if the accumulated value of the density levels is low to a certain degree, the apparatus obtains the average density of a portion to be drawn in print data, and calculates density information before density correction from correction information of output density characteristics. This makes it possible to implement toner consumption amount prediction with high accuracy and high robustness against the influence of variations in output density characteristics.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-031425, filed Feb. 20, 2013, which is hereby incorporated by reference herein in its entirety.

What is claimed is:

1. An image forming apparatus comprising:

a counting unit configured to count the number of pixels at each tone level in a halftone image corresponding to an input image;

a determination unit configured to determine a halftone region in the halftone image;

an acquisition unit configured to acquire tone characteristic information of an output density of the image forming apparatus;

a correction unit configured to obtain a density in a region to be formed by using a developing material corresponding to pixels in the halftone region from information of the halftone region and the number of pixels at each of the tone levels included in the halftone region and correct the density in accordance with the tone characteristic information;

a first prediction unit configured to predict a consumption amount of the developing material by using the density corrected by said correction unit; and an accumulation unit configured to obtain an accumulated value of densities in the halftone image from the number of pixels at each tone level acquired by said counting unit, wherein said first prediction unit predicts a consumption amount of the developing material from the accumulated value of densities obtained by said accumulation unit if the accumulated value of densities obtained by said accumulation unit is larger than a predetermined threshold.

2. An image forming apparatus comprising:

a counting unit configured to count the number of pixels at each tone level in a halftone image corresponding to an input image;

a determination unit configured to determine a halftone region in the halftone image;

an acquisition unit configured to acquire tone characteristic information of an output density of the image forming apparatus;

a correction unit configured to obtain a density in a region to be formed by using a developing material corresponding to pixels in the halftone region from information of the halftone region and the number of pixels at each of the tone levels included in the halftone region and correct the density in accordance with the tone characteristic information;

a first prediction unit configured to predict a consumption amount of the developing material by using the density corrected by said correction unit;

a second prediction unit configured to predict a consumption amount of the developing material by a method different from that used by said first prediction unit; and a control unit configured to perform control, in accordance with a type of the input image, to make one of said first prediction unit and said second prediction unit predict a consumption amount of the developing material.

3. The apparatus according to claim 2, wherein said control unit makes said first prediction unit predict a consumption amount of the developing material if the data of the input image is halftone image data, and makes said second prediction unit predict a consumption amount of the developing material if the data of the input image is a PDL command or RGB image data.

4. An image forming apparatus comprising:

a counting unit configured to count the number of pixels at each tone level in a halftone image corresponding to an input image;

a determination unit configured to determine a halftone region in the halftone image;

an acquisition unit configured to acquire tone characteristic information of an output density of the image forming apparatus;

a correction unit configured to obtain a density in a region to be formed by using a developing material corresponding to pixels in the halftone region from information of the halftone region and the number of pixels at each of the tone levels included in the halftone region and correct the density in accordance with the tone characteristic information;

a first prediction unit configured to predict a consumption amount of the developing material by using the density corrected by said correction unit, wherein the tone characteristics are defined as a correction table for correcting a value of a density at the time of outputting from the image forming apparatus, and said correction unit performs correction by setting the average value of the densities as a density after correction and converting the value into a value before correction by using the correction table.

5. A method of controlling an image forming apparatus, the method comprising:

a counting step of counting the number of pixels at each tone level in a halftone image corresponding to an input image;

a determination step of determining a halftone region in the halftone image;

an acquisition step of acquiring tone characteristic information of a density at the time of outputting from the image forming apparatus;

a correction step of obtaining a density in a region to be formed by using the developing material corresponding to pixels in the halftone region from information of the halftone region and the number of pixels at each of the tone levels included in the halftone region and correcting the density in accordance with the tone characteristic information; and a prediction step of predicting a consumption amount of the developing material by using the density corrected in the correction step, wherein the tone characteristics are defined as a correction table for correcting a value of a density at the time of outputting from the image forming apparatus, and wherein in the correction step, correction is performed by setting the average value of the densities as a density after correction and converting the value into a value before correction by using the correction table.

6. A non-transitory computer-readable medium storing a program for causing a computer to function as a counting unit configured to count the number of pixels at each tone level in a halftone image corresponding to an input image, a determination unit configured to determine a halftone region in the halftone image, an acquisition unit configured to acquire tone characteristic information of a density at the time of outputting from the image forming apparatus, a correction unit configured to obtain a density in a region to be formed by using a developing material corresponding to pixels in the halftone region from information of the halftone region and the number of pixels at each of the tone levels included in the halftone region and correct the density in accordance with the tone characteristic information, and a prediction unit configured to predict a consumption amount of the developing material by using the density corrected by the correction unit, wherein the tone characteristics are defined as a correction table for correcting a value of a density at the time of outputting from the image forming apparatus, and said correction unit performs correction by setting the average value of the densities as a density after correction and converting the value into a value before correction by using the correction table.

* * * * *